United States Patent [19]

Romano et al.

[11] 4,163,723

[45] Aug. 7, 1979

[54] CONTINUOUSLY OPERATED LIQUID-SOLIDS SEPARATOR

[75] Inventors: Giuliano Romano, Englewood, N.J.; Michael A. Rismondo, Houston, Tex.

[73] Assignee: National Petro Chemicals Corporation, New York, N.Y.

[21] Appl. No.: 846,471

[22] Filed: Oct. 28, 1977

[51] Int. Cl.[2] ..... B03B 5/36; C02C 1/28

[52] U.S. Cl. ..... 210/319; 210/320; 209/159

[58] Field of Search ..... 209/155, 158, 159, 17, 209/173, 461, 463, 465, 169, 171; 425/6, 8; 260/2.3; 210/162, 163, 168, 221 R, 221 M, 319, 320

[56] References Cited

U.S. PATENT DOCUMENTS

| | | | |
|---|---|---|---|
| 528,803 | 11/1894 | Ramsay | 209/159 |
| 636,675 | 11/1899 | Latimer | 209/158 |
| 851,599 | 4/1907 | Latimer | 209/171 X |
| 1,155,836 | 10/1915 | Owen | 209/169 |
| 1,665,081 | 4/1928 | Andrews | 209/18 X |
| 1,960,726 | 5/1934 | Briscoe | 209/465 |
| 2,047,643 | 7/1936 | Mayer | 209/169 |
| 2,167,788 | 8/1939 | Weinig | 209/169 |
| 2,410,633 | 11/1946 | Counselman | 209/17 X |
| 2,605,220 | 7/1952 | Logan | 210/319 |
| 2,696,913 | 12/1954 | Anderson | 209/169 |
| 3,064,806 | 11/1962 | Mukki | 209/17 |
| 3,490,589 | 1/1970 | Cymbalissy | 209/169 X |
| 3,925,200 | 12/1975 | Izumi | 209/166 X |

FOREIGN PATENT DOCUMENTS

| | | | |
|---|---|---|---|
| 360807 | 9/1919 | Fed. Rep. of Germany | 209/169 |
| 731287 | 6/1955 | United Kingdom | 209/158 |

*Primary Examiner*—Robert Halper

*Attorney, Agent, or Firm*—Kenneth D. Tremain

[57] ABSTRACT

A continuously operated liquid-solids separator for separating a powdered resin material suspended in water forming a slurry by permitting the resin, which is of a lower specific gravity than the water, to float or be impelled upwardly within a separator vessel or upright tank from which it is withdrawn through an outlet orifice as a thickened slurry. Anti-swirl baffles in the form of vertically extending plate members are located in circumferentially spaced relationship interiorly of the vessel in at least the upper regions thereof in order to restrict the undue agitation and swirling of the resinous material and limit resultant downward movement thereof as it floats upwardly within the liquid towards the outlet orifice, while agitation is imparted to the thickened slurry in the uppermost region of the separator vessel through the intermediary of a suitable rotatable impeller mounted in the upper section of the vessel proximate and at a level below the outlet orifice in order to maintain the accumulated resin or particulate material uniformly dispersed in the thickened slurry as the latter is being withdrawn from the separator. A generally horizontal stilling baffle or screen extends across the separator vessel between the inlet orifice for the solids-liquid suspension or slurry and an outlet orifice for the purer or clarified liquid located proximate the bottom of the separator.

17 Claims, 6 Drawing Figures

CONTINUOUSLY OPERATED LIQUID-SOLIDS SEPARATOR

BACKGROUND OF THE INVENTION

1. Field of the Invention

The present invention relates to an apparatus for the continuous separation of solids from a liquid suspension thereof and, more particularly, to a continuously operating powdered resin-water slurry separator which will separate essentially all of the resin as a concentrated fraction of the slurry, with the other fraction thereof being the balance of the water contained in the original feed slurry.

Generally, the invention relates to an apparatus or separator for continuously separating a powdered resin material, such as finely-divided high-density polyethylene particles, which is suspended in water and supplied to the separator as an infeed slurry, by permitting the resin, which is of a lower specific gravity than the water, to float upwardly within a vessel from whence it is withdrawn as a thickened slurry through an outlet orifice located in the upper portion of the vessel. The infeed slurry is fed into the lower central section of the vessel, and an outlet orifice for the clarified liquid or water is provided in the vessel proximate the base portion thereof.

Although numerous apparatuses and processes are currently known and in industrial use for the continuous or batchwise separation of solids which are suspended in liquid to thereby form a slurry, and wherein the solids are permitted to float gravitationally upwardly within a vessel or upright tank by being of a lower specific gravity than the liquid, the current state of the technology fails to provide structure which will effect the separation in a manner as efficiently and economically as that contemplated and attained by the present inventive liquid-solids separator.

2. Discussion of the Prior Art

Thus, Fontein U.S. Pat. No. 2,649,963 discloses a continuously operating separator for processing and continuously thickening or concentrating slurries of finely-divided solids suspended in a liquid media, in which an upwardly-reducing conical vessel has a slurry fed into the lower portion thereof, allowing the dispersed solids to float upwardly and form a thickened slurry, and with the fraction comprising relatively pure or clarified liquid being removed from proximate the bottom of the apparatus. The more concentrated suspension or thickened slurry is withdrawn from the upper end of the conical vessel through the intermediary of a vortex-type blower arrangement.

Lessing et al U.S. Pat. No. 1,989,937 discloses an apparatus for the separation from a liquid of a carbonaceous material suspended therein to form a slurry, in which particles having a specific gravity lower than that of the liquid will float to the top surface and will be skimmed off through the utilization of a conveyor system, with the purer or clarified liquid being allowed to flow out through an orifice provided in the bottom of a receptacle or vessel constituting the apparatus.

Grundler U.S. Pat. No. 1,169,479 and Walter U.S. Pat. No. 2,220,925 show separators for the separation of substances having different specific gravities, in particular particulate material entrained and suspended in a liquid forming a slurry, by incorporating stirring devices which will uniformly disperse the solids material in the slurry at the upper end of the apparatus in which the slurry is more concentrated, thereby imparting a constant consistency to the slurry.

Holz et al U.S. Pat. No. 3,964,996 discloses an apparatus for the separation of solids from a liquid suspension thereof, having a central feed slurry inlet provided in a vessel, in which fibrous suspension material of lower specific gravity than the liquid is allowed to float upwardly under the effect of gravity and withdrawn from the upper end of the apparatus, with the more pure or clarified liquid being withdrawn from the lower portion of the apparatus.

Although these and other publications each disclose and relate to various apparatuses and methods of processing slurries through the separating of solids from liquid suspensions, essentially through the application of the flotation principle in which the solids are of a specific gravity lower than that of the liquid in which they are entrained, none facilitate an economical operation analogous to that of the inventive apparatus, the latter of which incorporates novel anti-swirl baffles in the upper regions of the separator vessel which will prevent undue agitation of the solid material as it floats upwardly, due to infeed and convection currents; which incorporates a stilling baffle or screen extending across the lower portion of the separator in order to prevent any solids particles from being withdrawn through an outlet provided in the lower region of the separator for the purer or clarified slurry liquid; and which also incorporates means for imparting agitation to the thickened slurry proximate an outlet therefor arranged in the upper region of the separator in order to maintain the accumulated resin or solids particulate material in the slurry uniformly dispersed throughout the liquid in which it is suspended as the thickened slurry is being withdrawn from the separator.

SUMMARY OF THE INVENTION

Accordingly, in order to ameliorate or possibly obviate the limitations encountered in presently known and utilized prior art liquid-solids separators of the type described, the present invention contemplates the provision of a unique and novel continuously operated liquid-solids separator which will separate a powdered resin material suspended in water to form a slurry by permitting the resin, which is of a lower specific gravity than the water, to float or be impelled upwardly within a separator vessel or upright tank from which it is withdrawn through an outlet orifice as a thickened slurry. Anti-swirl baffles in the form of vertically extending plate members are located in circumferentially spaced relationship interiorly of the vessel in at least the upper regions thereof in order to restrict the undue agitation and swirling of the resinous material and limit resultant downward movement thereof as it floats upwardly within the liquid towards the outlet orifice, while agitation is imparted to the thickened slurry in the uppermost region of the separator vessel through the intermediary of a suitable rotatable impeller mounted in the upper section of the vessel proximate and at a level below the outlet orifice in order to maintain the accumulated resin or particulate material uniformly dispersed in the thickened slurry as the latter is being withdrawn from the separator.

In another aspect of the invention, the novel separating apparatus is provided with a generally horizontal stilling baffle or screen extending across the separator vessel which is interposed between the inlet orifice for the solids-liquid suspension or slurry and an outlet orifice for the clarified liquid located proximate the bottom of the separator vessel. The stilling baffle, in effect, will counteract the swirling influences imparted to the solid particles suspended in the liquid by convection currents present within the vessel which would be conducive towards propelling the solids particles or resin material downwardly towards the lower outlet orifice for the clarified liquid.

In greater particularity, the continuous operated liquid-solids separator or apparatus constructed pursuant to the present invention, consists of an upright tank constituted of a lower cylindrical section having superposed thereon an upwardly-reducing intermediate frustoconical section which, in turn, supports thereon a smaller-diameter cylindrical upper section. The tank is provided with an inlet conduit for the liquids-solids slurry in the lower cylindrical section thereof at an elevation proximate the base level of the vessel, and with the inlet flow of the liquid-stream suspension or slurry being directed upwardly along the central axis of the tank. A plurality of vertical baffle plates forming a first set of baffles are spaced about the inner circumference of the frusto-conical tank section and extend radially inwardly thereof so as to inhibit swirling movement of the upwardly floating or impelled solids in the liquid suspension, such movement being generated by differences in the density between the solids and the liquid and by the slurry inlet flow from the inlet conduit. Other narrow vertical plates forming a second set of baffles are arranged spaced about the inner surface of the upper cylindrical section of the tank, and extend radially inwardly thereof to a limited extent so as to assist in the mixing of the thickened slurry as it floats upwardly into the upper cylindrical section. A rotatable agitator, preferably in the form of a shrouded turbine impeller, is mounted on the tank and arranged in the large opening intermediate the upper vertical baffle plates at a level below the outlet orifice for the thickened slurry located in the upper cylindrical section. The agitator is rotated through the intermediary of a suitable drive arrangement mounted on the top of the tank, and will provide for the uniform dispersal of the solids in the thickened slurry prior to withdrawal thereof through the outlet orifice so as to assure that the slurry will be of a constant consistency.

A stilling baffle is mounted to extend substantially horizontally across the lower section of the tank at an elevation intermediate the inlet conduit for the slurry, and the lower arranged outlet orifice for the clarified liquid. The stilling baffle preferably comprises a screen which may be made of any liquid-pervious metallic or foraminous material, which will inhibit the downward movement and through-passage of the solids in the slurry caused by convection or circulating currents in the tank.

In particular, although not limited thereto, the inventive apparatus or separator for the continuous separation of solids from a liquid suspension or slurry thereof is suited for utilization in high-density polyethylene processing plants where the apparatus may be employed as a recycle water separator. When utilized in connection therewith, the slurry contains powdered resin in an aqueous slurry which is conveyed into the separator tank through the slurry inlet conduit, and in which the clarified water discharged from the lower outlet of the tank may be either discarded or recycled to the polyethylene processing installation for renewed use. The thickened slurry which is withdrawn from the separator tank at the upper outlet thereof may be recycled to the polymer process installation for further utilization or processing.

Accordingly, it is a primary object of the present invention to provide a novel and unique apparatus for the continuous separation of solids from a slurry-like liquid suspension thereof in an efficient and economical manner.

Another object of the present invention lies in the provision of a separator or apparatus for the continuous separation of solids from a powdered resin-water slurry, which will separate essentially all of the resin as a concentrated fraction of the slurry with the other fraction thereof being the balance of the water contained in the original feed slurry supplied to the separator.

Yet another object of the present invention lies in the provision of a separator of the type described which is essentially an upright tank adapted to facilitate the gravitational float separation of solids suspended in a liquid and forming a slurry, which incorporates anti-swirl baffles within the tank in order to afford an enhanced degree of control over the flow of the solid particles in the liquid during the upward flow and separation thereof.

A further object of the present invention is to provide a continuously operating separator of the above-described type which has a slurry supplied thereto having a predetermined concentration of solids particles suspended in liquid, the particles being withdrawn from the upper portion of the separator in a thickened slurry while the clarified liquid is withdrawn from the opposite or lower portion of the separator, agitating means being provided in the upper end of the separator for assuring that the concentrated slurry withdrawn therefrom is of a constant consistency.

These and other objects and advantages of the invention may be more clearly ascertained from the detailed description of a preferred embodiment as set forth hereinbelow.

BRIEF DESCRIPTION OF THE DRAWINGS

Reference may now be had to the following detailed description of a preferred embodiment of a continuously operating liquid-solids separator constructed pursuant to the invention, taken in conjunction with the accompanying drawings; in which.

DETAILED DESCRIPTION

Figure 1:
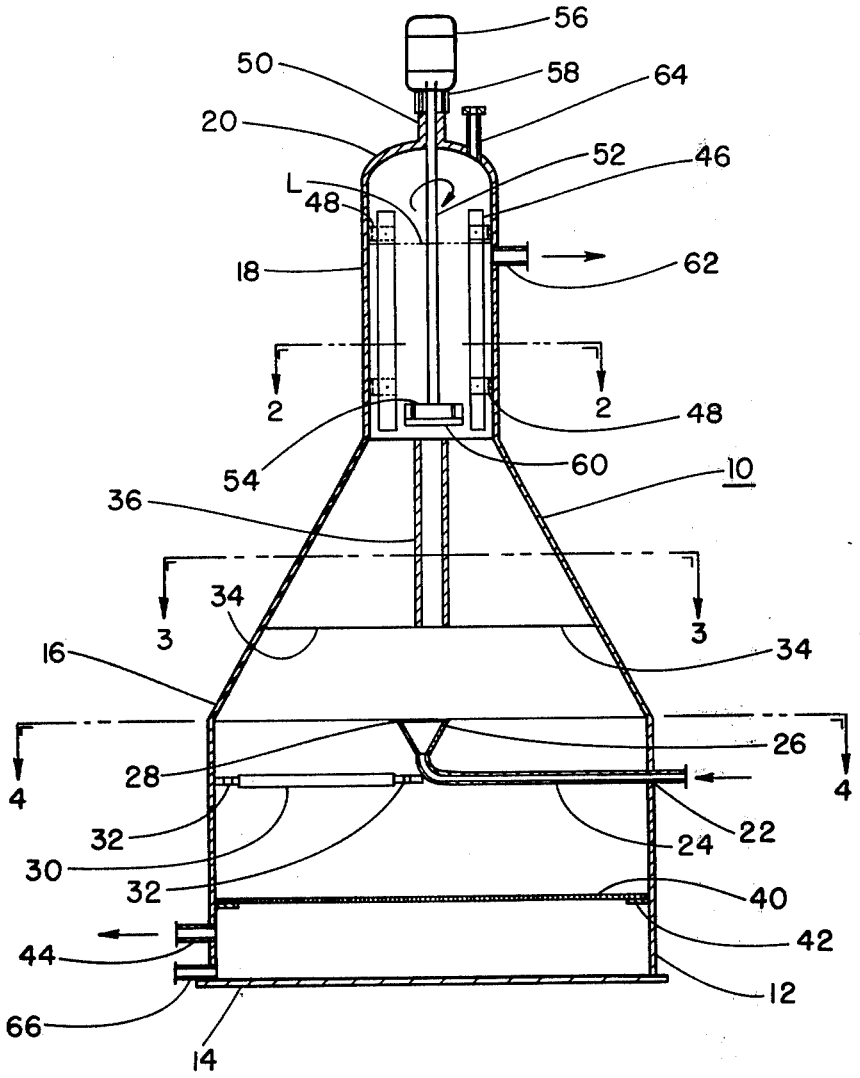
FIG. 1 illustrates an elevational sectional view of a liquid-solids separator in accordance with the present invention.

Referring now in detail to the drawings, in FIG. 1 there is illustrated a separator or apparatus for the continuous separation of solids from a slurry-like liquid suspension thereof. Basically, the separator consists of a closed generally upright tank or vessel 10 which is of generally circular or cylindrical cross-section. The upright tank 10 includes a lower cylindrical section 12 which is supported on a base plate 14. Supported on and extending upwardly from the top of the cylindrical section 12 is an upwardly-reducing frustoconical section 16 which, in turn, supports a smaller-diameter cylindrical section 18 on its upper end. A cover or closure member 20 is fastened to or integral with the upper cylindrical section 18 so as to impart to the vessel 10 a generally closed tank structure.

An inlet opening 22 is formed in the upper region of the lower cylindrical section 12, through which a conduit 24 projects generally horizontally into the tank 10 for conveying into the latter a feed slurry containing a predetermined quantity of powder or solid particulate material suspended in liquid. The inner end 26 of the slurry infeed conduit 24 is curved upwardly into generally the vertical longitudinal center line of the tank 10, and is shaped in the configuration of an expanding nozzle 28 so as to cause the slurry to be ejected into the tank 10 in an upwardly diverging stream.

In order to afford stiffening support to the slurry infeed conduit 24 in the tank, proximate its inner end 26 it is connected to a length of pipe 30 having turnbuckles 32 at the ends thereof, of which one is fastened to the inner wall of the section 12 of the tank, and the other end rigidly connected with the adjacent end 26 of the conduit 24.

Figure 3:
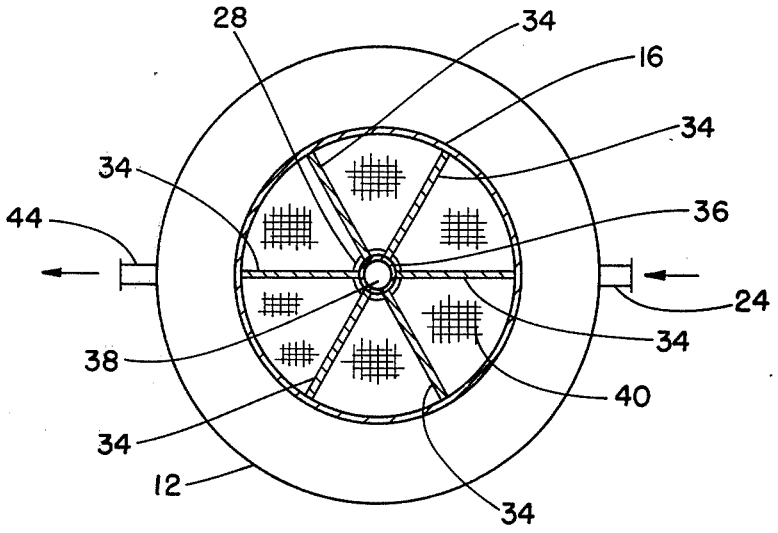
FIG. 3 is a sectional view taken along line 3—3 in FIG. 1.
Figure 4:
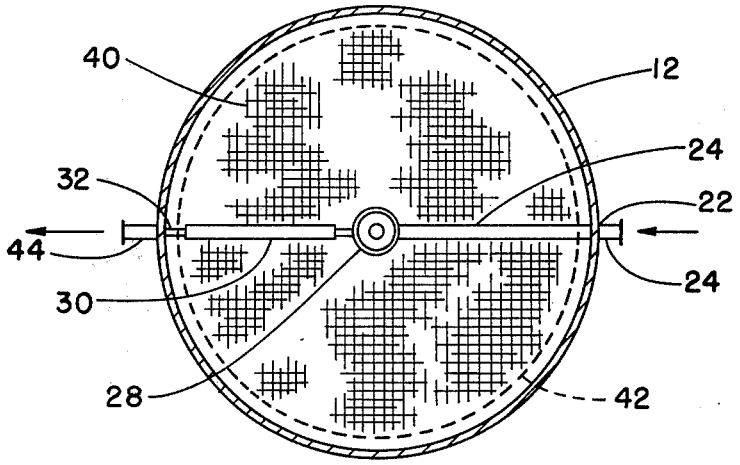
FIG. 4 is a sectional view taken along line 4—4 in FIG. 1.
Figure 6:
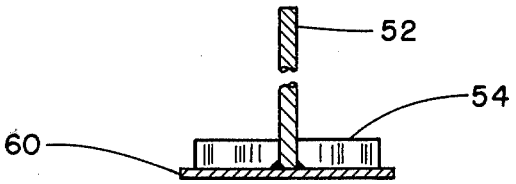
FIG. 6 is a sectional view taken along line 6—6 in FIG. 5.

Mounted in the frustoconical intermediate section 16 of the tank 10 are a plurality of radially inwardly extending vertical plates 34 forming a first set of baffles, as shown in FIG. 3 of the drawings, having their outer edges fastened to the inner conical surface of the tank and their radially inner edges fastened to, for instance by welding, a centrally located vertical pipe section 36. In effect, the plates 34 form a series of radially converging anti-swirl baffles which divide the interior of that portion of the frustoconical section 16 of the tank into a series of adjoining separate fluid through-flow passageways each in cross-section having substantially a pie-wedge shape, and a central through-flow passageway 38 defined by the interior of the vertical pipe 36.

Arranged in the lower cylindrical section 12 of the tank, in a plane below that of the inlet conduit 24, is a generally horizontally oriented stilling baffle 40, constituted of either a metallic liquid-pervious screen or a perforated baffle plate which will permit the downward passage therethrough of the slurry liquid being fed into the tank while concurrently stilling any downward currents and thus allow the solids entrained in the liquid to float upwardly in the tank. The stilling baffle or screen 40 is supported along the circumferential edge thereof on an annular metal ring 42 which is welded to the inner cylindrical wall of the cylindrical section 12.

Communicating with the interior of the tank, at a level or elevation below that of the stilling baffle or screen 40 and in proximity to the base portion of the tank 10, is an outlet connection 44 which is provided for the continuous withdrawal of clarified liquid separated from the slurry fed into the tank 10 through the infeed conduit 24 by being passed downwardly through the stilling baffle 40.

Figure 2:
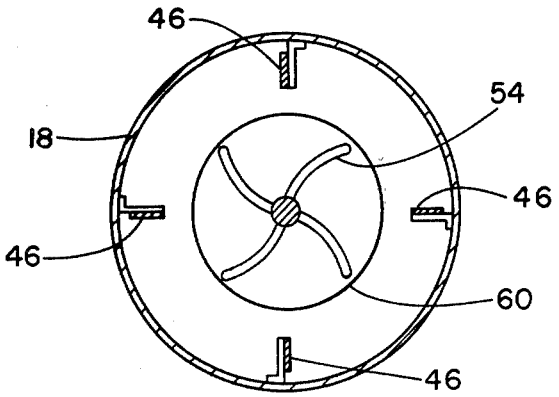
FIG. 2 is an enlarged sectional view taken along line 2—2 in FIG. 1.
Figure 5:
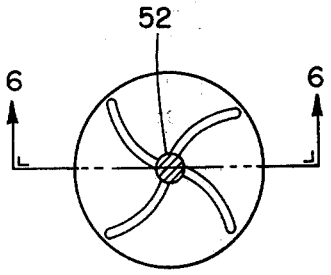
FIG. 5 is an enlarged fragmentary detail top plan view of the agitator in FIG. 1.

Located in the upper portion or cylindrical section 18 of the tank 10 is a second set of baffles consisting of a plurality of circumferentially spaced, radially converging baffle plates 46, as shown in enlarged sectional detail in FIG. 2 of the drawings. The baffle plates are narrow in width and extend only a limited extent radially inwardly so as to provide a large central opening therebetween in cylindrical section 18, being fastened to the inner circumferential wall of the cylindrical section 18 through the intermediary of suitable mounting brackets 48, such as by being welded or riveted thereto. Extending downwardly into the central opening in cylindrical section 18 through an upper projecting neck portion 50 on the closure member 20, is a vertically depending rotatable shaft 52, the lower end of which has a multi-bladed impeller 54 mounted thereon for rotation therewith at an elevation somewhat above the lower ends of the vertical baffle plates 46. The shaft 52 and impeller 54 are adapted to be driven by means of a suitable drive motor 56 which is mounted on the neck portion 50 and rotatably supported thereon through the intermediary of a suitable bearing arrangement 58. A shroud, preferably in the form of a flat plate 60, is mounted at the bottom of the impeller 54, for a purpose to be described in further detail hereinbelow.

Positioned intermediate two of the vertical baffle plates 46, in proximity to the upper ends thereof and in communication with the interior of the cylindrical section 18 of the tank 10, is a slurry outlet aperture or connector 62.

The closure member 20 is further provided with a vent conduit 64 providing for relief of any excess pressure buildup in the tank 10 during the operation of the latter or facilitating the overflow of excess liquid present therein.

Furthermore, for cleaning purposes, the tank 10 may be provided at the lowest point of the lower cylindrical section 12 adjacent the base plate 14 with a drain 66. Additionally, the tank may be provided at various locations with suitable fluid-tight manhole cover plates which will permit access to the tank for repair and servicing.

The operation of the separator or apparatus for the continuous separation of solids from a slurry-like liquid suspension thereof is as follows:

The tank is constantly filled with liquid, such as water or infeed slurry, up to at least a level L, the latter of which is above the elevation of the outlet aperture 62 in the upper cylindrical section 18. In effect, the entire tank 10 is at all times maintained in a liquid-filled condition up to the level L. A slurry, such as a powdered resin-liquid mixture is continuously pumped or fed into the tank 10 through the inlet conduit 24 and ejected upwardly in a diverging manner through the diverging nozzle 28 into the liquid filling the tank. As the slurry circulates through the tank, the solid particulate material or powdered resin in the liquid, which is of a specific gravity lower than that of the liquid, tends to gravitate or float upwardly through the frustoconical section 16 into the cylindrical section 18. However, due to the swirling imparted to the stream of slurry being introduced through inlet conduit 24, and other convection currents which are generated in the tank, possibly through temperature differentials or the like with respect to the exterior of the tank, the slurry and the particles entrained in the liquid are subjected to circular or swirling motions which may cause the resin powder or particles to be propelled downwardly towards the lower end of tank 10. The baffles 34 which divide the flow of the slurry into a plurality of discrete streams passing between baffle plates 34 and the interior 38 of vertical pipe 36 as the particles are gravitated upwardly, will inhibit or greatly reduce such swirling motion and cause the particles to laminarly stream upwardly within the liquid filling the tank.

Since it may not be possible to completely eliminate convection currents or some degree of swirling motion, particularly in the lower regions of the tank 10, which would cause particulate material or resinous powder entrained in the liquid to be drawn or propelled downwardly towards the outlet orifice 44 for the clarified liquid or water, the interposition of the perforated stilling baffle or screen 40, the latter of which may be of a liquid-pervious metallic baffle or any suitable screen, will prevent the particulate solids or resin powder from passing downwardly therethrough by stilling any downwardly acting currents in the tank and permitting the solids to float upwardly under the effects of gravity while allowing the clarified water to flow into the lower portion of the tank 10 below the screen 40, and from there to be withdrawn through the water outlet aperture or conduit 44, either through gravity flow or through the intermediary of a suitable water recycling pump (not shown).

The resin powder or particulate material which, due to being of a lower density or specific gravity than the liquid, will float upwardly through the lower cylindrical portion of the tank above the baffle 40 and the passageways between the baffles 34 and through passageway 38 and, together with the remaining solids entrained in the slurry liquid, enter into the upper portion or cylindrical section 18 of the tank where it forms a thickened slurry.

The thickened slurry which is now present in the upper section 18 at the tank, is maintained at a generally uniform degree of dispersion or consistency through agitation imparted thereto by the agitator or impeller 54 which is rotated at a suitably high speed, and which is shrouded along its lower surface by means of plate 60 so as to prevent particulate material or resin powder from downward movement therepast and return into the lower sections of the tank 10.

The vertical baffles 46 which extend radially inwardly from the inner surface of cylindrical portion 18 into proximity with the outer periphery of the agitator 54, will impede the swirling motion of the thickened slurry and aid in its laminar flow towards the outlet aperture or conduit 62, from which the slurry is withdrawn from the tank through the action of a suitable suction pump (not shown).

Although the tank 10 constituting the separator has generally broad applications and can be employed for the separation of any solids or powder entrained or suspended in a liquid, and in which the solids are of a lower specific weight than the liquid, the invention has found particular application in installations which are engaged in the processing of high-density polyethylene, wherein an aqueous slurry containing powdered resin or finely-divided particulate polyethylene is processed through the separator or tank 10 in order to provide for the removal or recycling of clarified process water through outlet 44, and the recovery and recycling into the processing installation of a thickened slurry containing a higher proportion of solids to liquid through the outlet conduit 62.

Thus, in a specific application of the invention employed in the recycling of polyethylene powder or resin suspended in water to thusly form an aqueous slurry, there may be utilized a liquid-solids separator comprising a tank of the type described, in which the lower cylindrical section 12 is 14 feet in diameter and 8 feet high, the intermediate frustoconical section 16 being somewhat more than 8 feet high and reducing at its upper end to a diameter of 4 feet, and the upper cylindrical section 18 about 8 feet high and having a diameter of 4 feet. This tank has a capacity of 2000 gallons of liquid, and is able to continuously process up to 240,000 lb. of infeed slurry mixture per hour under atmospheric pressure. In that instance, when applied to the processing of high-density polyethylene powder having a specific gravity of 0.85, all of the essential components of the tank structure, including internal components and agitator may be preferably constructed of stainless steel in order to minimize any wear due to corrosion. Preferably, the agitator should be constructed of a shrouded four-bladed impeller being adapted to rotate at speeds of up to 100 RPM.

Furthermore, although six baffles 34 are illustrated in the frustoconical section 16, and four baffle plates 46 in the cylindrical section 18, the tank will function satisfactorily with either a larger or lesser number of baffle members in each section, although from a practical standpoint, a minimum of four baffles in each section would be desirable. Moreover, the baffle plates in the upper section 18 need not be in axial alignment with the baffle plates in the intermediate frusto-conical section 16, but may be radially arranged in any randomly offset manner with regard to each other.

In order to reduce, or possibly even eliminate, convection currents within the tank, it may be desirable to insulate the tank so as to reduce temperature gradients between the ambient atmosphere and the interior of the tank, such temperature differentials being the cause of convection currents imparting swirling motion to the slurry tending to pull the solid particulate material or resin powder downwardly in the tank 10.

In effect, the inventive separator apparatus has universal application to any liquid-solids combination provided the solid particulate material is of a specific gravity less than that of the liquid in which it is suspended.

It is readily apparent to one skilled in the art that numerous modifications are possible within the context of the above disclosure and, accordingly, it is to be understood that, within the scope of the claims, the invention may be practiced otherwise than specifically described.

What is claimed is:

1. In an apparatus for the continuous separation of solids from a liquid suspension thereof and in which said solids have a tendency to float upwardly in the liquid; an upright tank comprising a lower cylindrical section, an upwardly-reducing imperforate frusto-conical intermediate section coextensive with said lower section, and an upper smaller-diameter cylindrical section coextensive with said frusto-conical intermediate section, said tank being essentially cylindrical in transverse section, and further having a bottom end wall; liquid suspension inlet means communicating with said tank at a level intermediate the upper and lower ends thereof; a first outlet aperture in said tank proximate the lower end thereof located in a plane below said inlet means; a second outlet aperture in said tank proximate the upper end thereof located in a plane above said liquid suspension inlet means; vertically extending baffles in said tank disposed intermediate said inlet means and said second outlet aperture for inhibiting swirling movement of said liquid suspension, said vertically extending baffles comprising a plurality of plate members spaced about the inner circumferential wall of said tank and projecting radially inwardly towards the vertical longitudinal axis of said tank; and means for agitating said liquid suspension being disposed in said tank in the region intermediate said second outlet aperture and said inlet means for impelling solids in the liquid suspension in said region upwardly towards said second outlet aperture for withdrawal from said tank.

2. An apparatus as claimed in claim 1, comprising a generally horizontal baffle member extending across the interior of said tank at an elevation intermediate said liquid suspension inlet means and said first outlet aperture, said baffle member forming a liquid-pervious barrier allowing for the downward passage therethrough of relatively pure liquid from said liquid suspension adapted to be withdrawn from said tank through said first outlet aperture while solids contained in said suspension will float upwardly within said tank.

3. An apparatus as claimed in claim 2, said liquid-pervious baffle member comprising a perforated metallic grid.

4. An apparatus as claimed in claim 2, said liquid-pervious baffle member being constituted of a screen.

5. An apparatus as claimed in claim 1, said agitating means comprising a rotatable impeller; said impeller including means restraining downward movement of solids in said liquid suspension above said impeller; and means for imparting a predetermined speed of rotation to said impeller to maintain said solids dispersed in said liquid suspension while concurrently preventing downward movement thereof in said tank and to conduct said solids upwardly towards said second outlet aperture.

6. An apparatus as claimed in claim 5, said impeller comprising a shrouded impeller.

7. An apparatus as claimed in claim 1, said agitating means comprising a shrouded turbine rotor.

8. An apparatus as claimed in claim 1, said liquid suspension inlet means and said first outlet aperture communicating with the lower cylindrical section of said tank, and said second outlet aperture communicating with the upper cylindrical section of said tank.

9. An apparatus as claimed in claim 1, said vertically extending baffles comprising a first set of baffles formed of a plurality of circumferentially spaced plate members fastened to the inner conical surface of the frusto-conical section of said tank; and a second set of baffles formed of a plurality of circumferentially spaced plate members fastened to the inner cylindrical wall of said upper cylindrical section of said tank, said plate members extending towards the vertical longitudinal axis of said tank.

10. An apparatus as claimed in claim 9, said first and second sets of vertically extending baffles having the plate members thereof extending radially towards the axis of said tank and being equi-distantly spaced about the inner circumference of said tank.

11. An apparatus as claimed in claim 9, said first set of baffles extending across substantially the entire radial dimension of said frusto-conical section towards the vertical center line of said tank.

12. An apparatus as claimed in claim 9, said second outlet aperture communicating with said upper cylindrical section of said tank intermediate two adjacent plate members of said second set of baffles.

13. An apparatus as claimed in claim 9, said plate members of said second set of baffles being essentially narrow in width and extending only a portion of the radial dimension of said upper cylindrical tank section towards the vertical center line of said tank.

14. An apparatus as claimed in claim 9, said agitating means being disposed in the upper cylindrical section of said tank at an elevation below said second outlet aperture and above the lower ends of the plate members of said second set of baffles.

15. An apparatus as claimed in claim 1, comprising drive means mounted on the upper end of said tank; and a vertically depending rotatable drive shaft connected to and extending from said drive means into said tank, said agitating means being fastened to the lower end of said shaft means and rotatable therewith.

16. An apparatus as claimed in claim 1, said liquid suspension inlet means comprising a tubular member extending generally horizontally into said tank, said tubular member having an upwardly oriented discharge orifice for ejecting said liquid suspension upwardly into said tank and centrally thereof.

17. An apparatus as claimed in claim 1, said solids in said liquid suspension comprising finely particulate high-density polyethylene.

* * * * *